United States Patent [19]

Davies

[11] 4,061,255

[45] Dec. 6, 1977

[54] DRIP CONTROLLING SPOUT

[76] Inventor: Thomas R. Davies, 2850 Mesa Verde Drive E., Costa Mesa, Calif. 92626

[21] Appl. No.: 725,791

[22] Filed: Sept. 23, 1976

[51] Int. Cl.[2] ..... B65D 25/42

[52] U.S. Cl. ..... 222/566

[58] Field of Search ..... 222/571, 108, 109, 566, 222/567, 572, 573, 574, 420

[56] References Cited

U.S. PATENT DOCUMENTS

| | | | |
|---|---|---|---|
| 1,512,964 | 10/1924 | Willis | 222/571 |
| 1,663,317 | 3/1928 | Richheimer | 222/571 |

FOREIGN PATENT DOCUMENTS

| | | | |
|---|---|---|---|
| 476,028 | 11/1937 | United Kingdom | 222/571 |

*Primary Examiner*—Allen N. Knowles
*Assistant Examiner*—Hadd Lane
*Attorney, Agent, or Firm*—George F. Bethel; P. K. Bethel

[57] ABSTRACT

The following specification teaches a drip controlling spout with a downwardly oriented opening. The rim of the upper leading edge projects below the rim of the under or trailing edge, so that liquid flowing through the spout will fall off the upper projecting rim avoiding drips down the neck of the spout.

11 Claims, 10 Drawing Figures

DRIP CONTROLLING SPOUT

BACKGROUND OF THE INVENTION

1. Field of the Invention

This invention relates to the field of spouts and particularly to a drip controlling spout.

2. Description of the Prior Art

In the past, spouts, and particularly spouts on teapots, have been offered with varying configurations for the purposes of avoiding dripping of liquids from the spout after the use thereof. Examples of such spouts include, among others, those having upwardly oriented openings often with an exaggerated lip at the end thereof, Such lips sometimes have a forked configuration at the end.

These spouts with upwardly oriented openings have been available in circular cross section, as well as other cross sectional configurations, such as for example, square, oval, and the like. Still other spouts are formed with a curved neck, so that the spout opening has a downwardly oriented configuration. These spouts also have varying cross sections of the spout with a corresponding opening. However, they all share the commonality of the lower edge projecting below the upper edge.

Many such spouts have a throat or curved neck with the opening at varying angles, ranging from the horizontal to directly downwardly. Frequently, the upper rim of the spout opening is slightly offset with respect to the projecting lower edge which is often slightly extended to form a lip.

In addition to the above types of spouts, there are also curved spouts having a downwardly oriented opening wherein the spout is simply truncated in its downwardly projected path. In this instance, the rim of the upper and lower edge terminate at the same level, so that neither edge can be said to project below the other.

All of the foregoing spouts that have been described above suffer from the drawback of permitting liquids flowing therethrough to drip down the neck of the spout. This is due to the fact that the liquid flowing therethrough flows by gravity to the lowest point on the spout when pouring liquids therethrough.

For example, a teapot is generally lifted with the hand to pour a liquid and at the termination of the pouring is placed on a flat surface. The liquid remaining in the spout at the point when the pot is returned to a flat surface, is divided at the throat, so that a portion of it flows forward and a portion of it flows backwardly into the pot. The portion flowing forwardly usually amounting to only a few drops, flows according to gravity to the lowest point, which in the above described spout designs, is the upper edge of the spout. After several such pourings, the amount dribbling adds up to an annoying situation.

In the case of the downwardly oriented spouts with the horizontal openings, the drops of fluid at the end of a pouring will fall off any and all parts of the spout rim, but particularly that of the throat due to gravitational pull.

As an aside, once the dribble starts down the neck of the spout, the other droplets will follow due to the lower surface tension at the spout neck, as opposed to that required for a droplet to form and drop from the spout rim.

Until the present time, there has been no satisfactory spout which overcame the problem of dribbles down the neck of the spout. Naturally, such a spout would be useful, not only for teapots and the like, but also for water faucets and related spouts. The reason for this is that it is desirable for water coming through a water spout to fall into the basin, rather than down the neck of the spout onto the spout fixture, which eventually causes corrosion of the water faucet.

SUMMARY OF THE INVENTION

The dripless spout of the invention comprises a spout with a downwardly oriented spout opening wherein the terminus or rim of the upper leading edge projects below the terminus or rim of the lower trailing edge as viewed substantially from the horizontal. The effect of this spout configuration is that when liquids flow through the spout, the droplets fall off the upper, or leading projecting rim, instead of the under trailing edge, as in the prior art spouts.

It is believed that this takes place in the following manner: As the flow of fluid through the spout diminishes to a point where drops are formed, the droplets coalesce to run downwardly by gravitational pull to the projecting rim where they immediately fall off at the cessation of liquid flow. This action takes place rapidly enough so that the final drops of liquid fall into the desired location instead of down the neck of the spout.

DESCRIPTION OF THE DRAWINGS

The invention will be more clearly understood by reference to the description below taken in conjunction with the accompanying drawings wherein.

DESCRIPTION OF THE PREFERRED EMBODIMENTS

Figure 1:
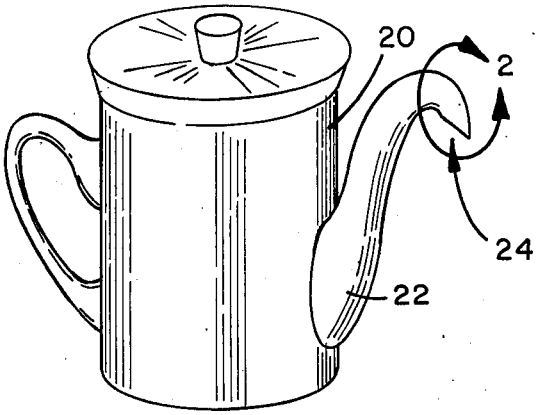
FIG. 1 shows a teapot having a spout embodying the elements of this invention.

Referring now to FIG. 1 there is shown a teapot 20 having an attached spout 22. The spout has a gooseneck configuration with a downwardly oriented opening 24. As shown in greater detail in FIG. 2, the spout opening has an upper projecting edge 26 which projects below the under or trailing edge 28. The spout opening which is shown in FIG. 3 is in effect a diagonal upward view looking at the spout.

Figure 2:
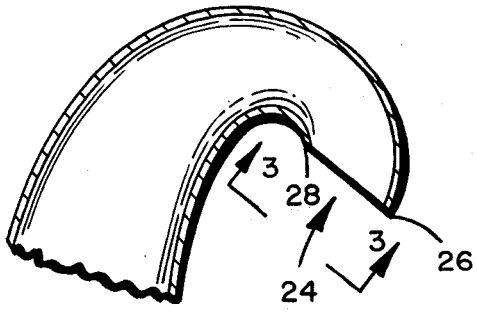
FIG. 2 shows an enlarged sectional view of the spout of FIG. 1 as indicated by circle 2.
Figure 3:
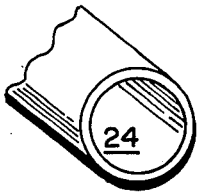
FIG. 3 shows a view of the spout of FIG. 2 as taken in the direction of lines 3—3.
Figure 5:
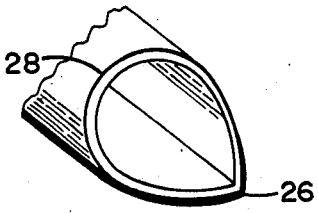
FIG. 5 shows a spout according to the invention having a crimped projecting edge.

Liquid flowing through the spout of FIG. 2 initially will part from all edges of the spout opening if the flow is great enough. However, when the flow is diminished, the liquid will flow from the trailing edge 28 downwardly toward the projecting edge 26 where it will fall off at that point. At the same time, any remaining moisture on the interior surface of the spout will tend to coalesce and also come downwardly to point 26. This follows as in the case of the teapot shown in FIG. 1 when the pot is lifted to pour liquid into some desired location. At the point where it is set down, the drips will have fallen off the projecting edge 26, so that there are no remaining droplets to fall down the throat of the spout and soil the surface beneath it.

While the invention is illustrated with the spout attached to a teapot, it should be understood that the invention is intended to encompass spouts attached to other bodies, such as for example, water faucets, oil cans, and the like.

It will be apparent that the invention lies in having the upper leading edge projecting below the lower trailing edge 28 so that the cross sectional configuration of the spout is not generally a limiting factor.

Figure 4:
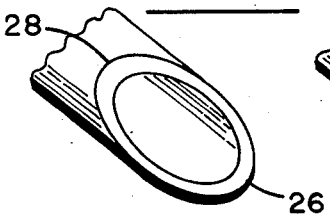
FIG. 4 shows a spout according to the invention having an oval cross section.

The spout of FIG. 2 as viewed from 3—3 as shown in FIG. 3, has a circular cross section. FIG. 4 shows an oval cross section which is equally desirable. There is, however, some advantage to having the projecting edge 26 terminate in a pointed configuration as opposed to a round or flattened configuration, since the droplets will have a greater tendency to coalesce and fall off rapidly than in the aforementioned configuration.

FIGS. 5 through 9 illustrate this preferred embodiment. Beginning with FIG. 5, it can be seen that the generally teardrop configuration or cross section of the spout is oriented so that the projecting edge 26 is narrowed to provide a point to the spout where the drops will fall off. The under or trailing edge 28 is rounded by contrast.

Figure 8:
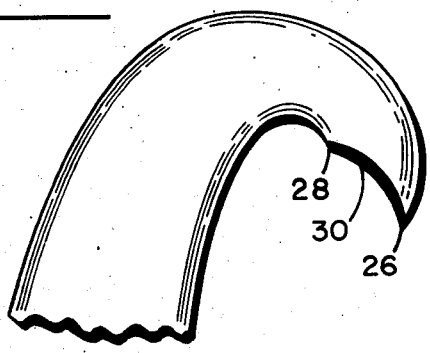
FIG. 8 shows a spout having an arcuate curve on the side walls between the projecting and trailing edges.

FIG. 8 shows a spout with a pointed projecting edge 26 with side walls 30 which form an arcuate line or curve between the projecting edge 26 and the trailing edge 28.

Figure 6:
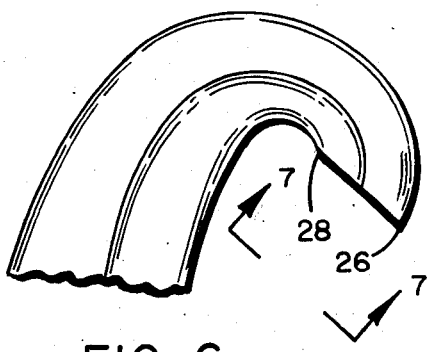
FIG. 6 shows an alternative embodiment of the invention.
Figure 7:
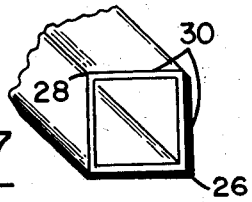
FIG. 7 shows the spout opening of FIG. 6 as shown in the direction of lines 7—7.
Figure 10:
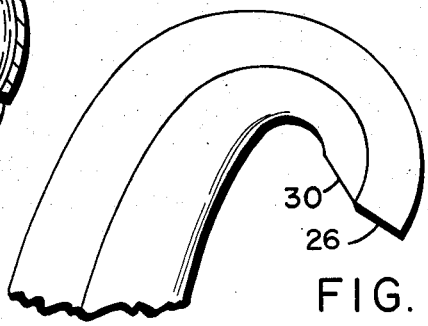

FIG. 6 shows a spout with a square cross section as shown in FIG. 7. The orientation of the square is such that the terminus of the projecting edge 26 in one corner of the cross sectional square configuration, and the trailing edge is its diametrically opposite corner 28. However, it should be understood that the flattened portion or cross section can act as the projecting edge and its opposite side be the trailing edge 28 as shown in FIG. 10.

Figure 9:
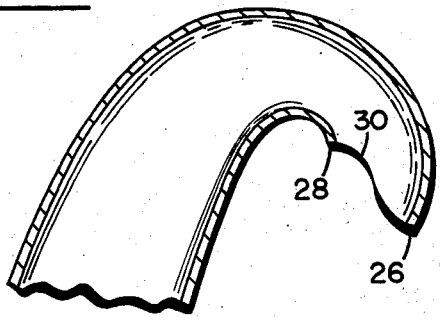
FIG. 9 shows a cross section of a spout having an exaggerated lip and side wall configuration; and, FIG. 10 shows another alternative embodiment of the invention.

Referring now to FIG. 9, there is shown a spout having the side walls 30 rising slightly to form an S shape, which cooperates on both sides to form a rounded bill or beak to the projecting edge 26.

The above description illustrates several embodiments of the invention incorporating a leading edge which projects below and under a trailing edge to control and cause droplets to fall off the front of the spout as opposed to the back side, which prevents dribbles down the neck of the spout. The embodiments have been illustrated in conjunction with a teapot as shown in FIG. 1. It will be apparent, however, that such spouts are usable in other applications, such as water faucets, oil cans, fountains, gasoline pump nozzles, and the like. Other applications will be apparent to those skilled in the art and can be resorted to without departing from the spirit and scope of the invention as defined by the following appended claims.

I claim:

1. The improvement in a spout affixed to a container for dispensing liquid therefrom comprising:

a spout formed from a single conduit having a passage completely enclosed along the length thereof from the entrance to the exit and having a downwardly displaced exit opening, wherein the terminus of the leading edge projects below the terminus of the trailing edge and said passage at the exit opening is formed in conduit walls of substantially uniform thickness so that liquid flowing through said spout falls off the forward portion of the projecting rim provided by the leading edge.

2. A spout as claimed in claim 1 wherein:
said spout is substantially circular in cross section.

3. A spout as claimed in claim 1 wherein:
said spout is substantially rectangular in cross section.

4. A spout as claimed in claim 1 wherein:
said spout is attached to a pot.

5. A spout as claimed in claim 1 wherein:
said leading edge is slightly enlarged in width at its terminus to form a beak to the spout.

6. A spout as claimed in claim 1 wherein:
the terminus of said projecting edge tapers to a point.

7. A spout as claimed in claim 1 wherein:
said spout has a substantially teardrop cross section.

8. A spout as claimed in claim 1 wherein:
said spout has a substantially oval cross section.

9. A spout as claimed in claim 3 wherein:
the cross section of said spout is oriented such that the diagonally opposite corners of the square form the terminus of the leading edge and of the trailing edge.

10. A spout as claimed in claim 1 wherein:
the terminus of said projecting edge at its leading portion is crimped.

11. A spout as claimed in claim 1 wherein:
the side edges of said spout between said projecting and trailing edges are at least partially curved upwardly relative to a straight line drawn from said trailing edge to said projecting edge.

* * * * *